US007832126B2

(12) United States Patent
Koellner et al.

(10) Patent No.: US 7,832,126 B2
(45) Date of Patent: Nov. 16, 2010

(54) SYSTEMS, DEVICES, AND/OR METHODS REGARDING EXCAVATING

(75) Inventors: Walter G. Koellner, Suwanee, GA (US); Joy Mazumdar, Norcross, GA (US); Daniel W. Robertson, Cumming, GA (US); Ken Furem, Cumming, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 97 days.

(21) Appl. No.: 12/122,122

(22) Filed: May 16, 2008

(65) Prior Publication Data

US 2008/0282583 A1 Nov. 20, 2008

Related U.S. Application Data

(60) Provisional application No. 60/938,555, filed on May 17, 2007.

(51) Int. Cl.
*E02F 5/02* (2006.01)

(52) U.S. Cl. ..... 37/348

(58) Field of Classification Search ..... 37/348, 37/466, 468, 395–399; 414/690, 718, 728; 701/50

See application file for complete search history.

(56) References Cited

U.S. PATENT DOCUMENTS

| | | | |
|---|---|---|---|
| 3,207,339 | A | 9/1965 | Neslin |
| 3,518,444 | A | 6/1970 | Barber |
| 4,884,939 | A | 12/1989 | Nielsen |
| 5,065,326 | A | 11/1991 | Sahm |
| 6,223,110 | B1 | 4/2001 | Rowe |
| 6,247,538 | B1 | 6/2001 | Takeda |
| 6,263,595 | B1 | 7/2001 | Ake |
| 6,363,632 | B1 | 4/2002 | Stentz |
| 6,466,850 | B1 | 10/2002 | Hilgart |
| 6,480,773 | B1 | 11/2002 | Hilgart |
| 6,691,010 | B1 | 2/2004 | Gay |
| 2001/0045032 | A1 | 11/2001 | Kleffner |
| 2005/0083196 | A1 | 4/2005 | Furem et al. |
| 2006/0090378 | A1 | 5/2006 | Furem |

FOREIGN PATENT DOCUMENTS

| | | |
|---|---|---|
| EP | 0811728 | 10/2002 |

OTHER PUBLICATIONS

International Search Report dated Sep. 4, 2008 for Application No. PCT/US2008/006412.

*Primary Examiner*—Robert E Pezzuto
(74) *Attorney, Agent, or Firm*—Filip A. Kowalewski

(57) ABSTRACT

Certain exemplary embodiments can provide a system, which can comprise a bucket excavation controller. The bucket excavation controller can be adapted to control one or more digging functions of a mining excavator. For example, the bucket excavation controller can be adapted to automatically control a crowd motion of the mining excavator.

18 Claims, 14 Drawing Sheets

5000

$$BCM = k \cdot width_{bucket} \sum_{\alpha_{entry}}^{\alpha_{exit}} depth_{bucket}(\alpha)$$

$$Tonnes = BCM \cdot density_{material}$$

10000

13000

14000

SYSTEMS, DEVICES, AND/OR METHODS REGARDING EXCAVATING

CROSS-REFERENCES TO RELATED APPLICATIONS

This application claims priority to, and incorporates by reference herein in its entirety, pending U.S. Provisional Patent Application Ser. No. 60/938,555, filed 17 May 2007.

BACKGROUND

Mining excavators, such as mining shovels and draglines used in open pit mining, can be relatively difficult to operate. An operator can coordinate several of motions of a mining excavator (e.g., hoist, crowd, and swing motions) in performing a digging cycle. For example, to begin the digging cycle on a mining excavator, the operator can coordinate motions such as braking a hoist that is being lowered, accelerating a crowd motor that is moving in a forward direction, and/or braking a swing motor that is turning the mining excavator. Certain improvements to systems, devices, and/or methods regarding excavating can be used to improve operation of mining excavators.

SUMMARY

Certain exemplary embodiments can provide a system, which can comprise a bucket excavation controller. The bucket excavation controller can be adapted to control one or more digging functions of a mining excavator. For example, the bucket excavation controller can be adapted to automatically control a crowd motion of the mining excavator.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
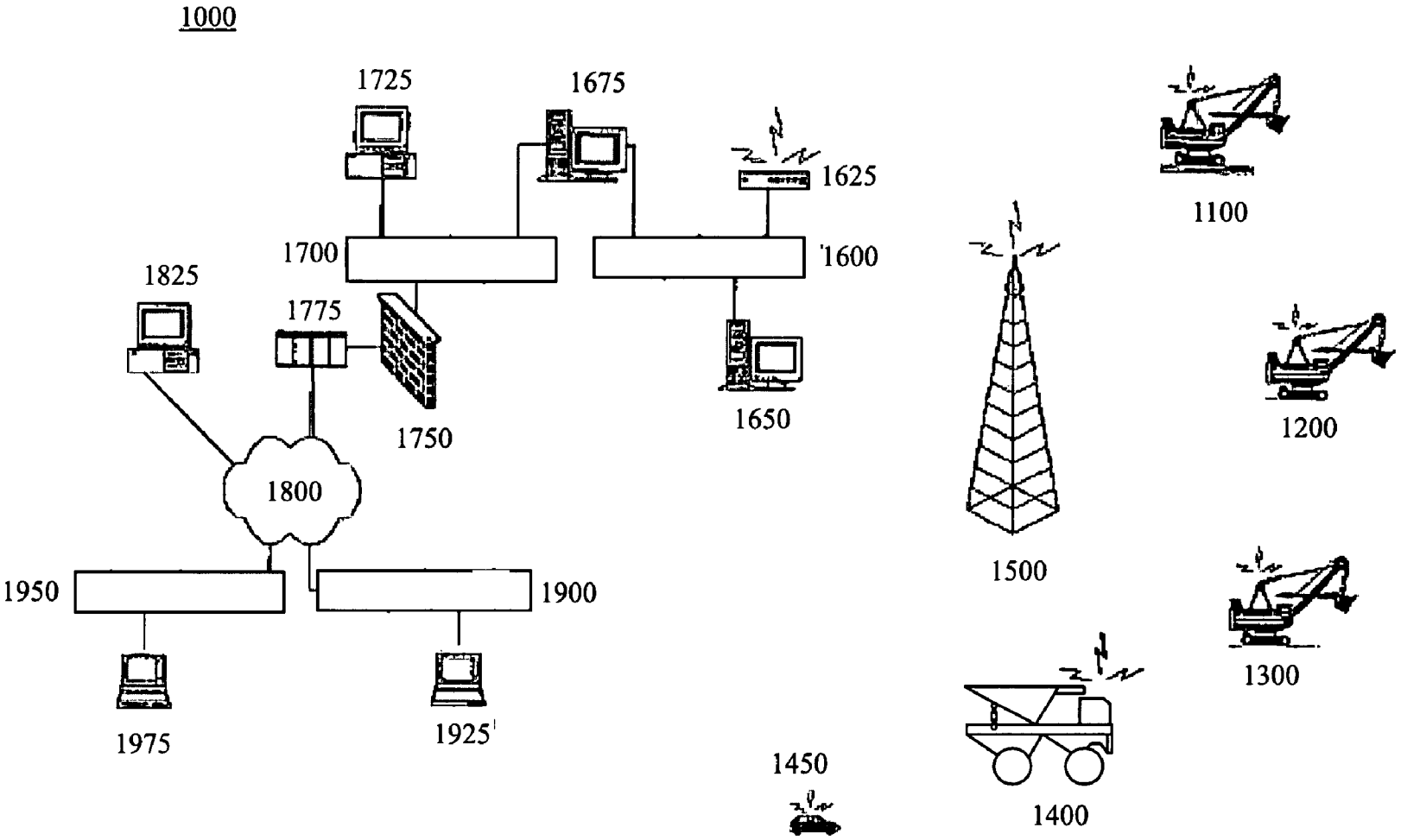
FIG. 1 is a block diagram of an exemplary embodiment of a system 1000.

Certain exemplary embodiments can provide a system, which can comprise a bucket excavation controller. The bucket excavation controller can be adapted to control one or more digging functions of a mining excavator. For example, the bucket excavation controller can be adapted to automatically control a crowd motion of the mining excavator.

Certain exemplary embodiments can provide automatic operator aides, which can make operation easier, more predictable, and/or allow less skilled mining excavator operators to improve relative machine productivity. Certain exemplary embodiments provide automatic aides that help the operator of the mining excavator to achieve relatively desirable duty cycle times and/or increase productivity in relative terms. Certain exemplary embodiments can utilize alternating current motors for hoist, swing, and/or crowd applications to improve mining excavator performance.

In certain exemplary embodiments, cycle times associated with a mining excavator can be monitored and/or analyzed. For example, cycle times can comprise times associated with digging, waiting, cleaning up, propelling the mining excavator, and/or system off time. For example, in an exemplary mine and/or mining excavator, approximately 79% of available time can be spent digging, approximately 9.3% of available time can be spent waiting, approximately 5.1% of available time can be spent cleaning up, approximately 3.1% of available time can be spent propelling the mining excavator, and approximately 3.5% of available time can be spent as system off time. A digging time can be divided into times for filling the bucket, swinging the bucket over a mining haulage vehicle, dumping the bucket into the mining haulage vehicle, and returning the bucket to a digging location. In an exemplary mining operation, the digging time can comprise a fill time of approximately 11 seconds, a time to swing the bucket over the mining haulage vehicle of approximately 11.5 seconds, a time to dump the bucket into the mining haulage vehicle of approximately 3 seconds, and a time to return the bucket to the digging location of approximately 8.3 seconds.

Certain exemplary embodiments can comprise a system, device, and/or method for improving duty cycle time for mining excavator digging operations. Certain exemplary embodiments can be adapted to:

- automatic position a bucket of the mining excavator at a beginning of a digging cycle;
- automatic control a hoist and/or crowd to avoid stalling of the bucket in a bank (bank=digging surface);
- estimate and/or measure a weight of the bucket weight while digging in the bank, that is, while material is being added to the bucket;
- position the excavator in front of the bank;
- provide a relatively rapid transfer between hoist and propel motions;
- place a mining haulage vehicle for shovel loading;
- automatic swing and/or position the bucket to load the mining haulage vehicle; and/or
- use of one or more of these features embodied in a mining excavator operator training simulator.

Certain exemplary embodiments can provide a method adapted to automatically position a bucket of a mining excavator in a predetermined location as a digging cycle begins. The method can comprise a plurality of activities that can comprise, based upon position coordinates obtained via laser and/or radar measurement, determining a desired location of the mining excavator and/or mining haulage vehicle relative to a predetermined portion of an earthen material bank. The position coordinates can be absolute and/or relative to the predetermined portion of the earthen material back, the mining excavator, the mining haulage vehicle, and/or any other object associated with a mining operation. Certain exemplary embodiments can utilize a superimposed position control in hoist, crowd, and/or swing motions of the mining excavator to position the bucket at a desired starting point for a digging cycle.

Certain exemplary embodiments can provide a method adapted to coordinate hoist and crowd motions to avoid a stall if the bucket in the bank. The method can provide a plurality of activities that can comprise automatically determining that the bucket is in a digging position in the bank, automatically determining that the bucket is about to stall, and/or automatically attempting to accelerate the bucket towards a predetermined desired hoist speed. The determination that the bucket is about to stall can be based upon an increase in a deviation between the predetermined desired hoist speed and an actual hoist speed as the actual hoist speed decreases and trends towards zero with a torque of the hoist at a maximum level. The predetermined desired hoist speed can be obtained from a master switch. While the operator controls hoist motion, the crowd motion can be automatically modified to attempt to maintain the predetermined desired hoist speed while digging in the bank. If the hoist speed is determined to be too high, the crowd motor can automatically impel the bucket against the bank to increase filling of the bucket. If the hoist speed becomes too small, the crowd motor can automatically retract the bucket in a direction away from the bank until a desired minimum hoisting speed is achieved.

Certain exemplary embodiments can provide a method for material weight estimation and/or weight measurements of the bucket while digging in the bank. The method can provide a plurality of activities that can comprise automatically determining that the bucket is in a digging position in the bank and/or automatically obtaining information regarding a torque and/or active current utilized to hoist the bucket through the bank. The total torque can be measured at the hoist motor. The total torque can comprise a torque associated with an actual weight of material in the bucket, a torque that lifts the bucket when empty, a torque used to overcome bank resistance, and/or a torque that accelerates the bucket through the bank. The material weight can be established by subtracting torques such as the aforementioned empty bucket torque, bank resistance torque, and/or accelerating torque from the total measured torque.

In certain exemplary embodiments, the weight of the material in the bucket can be estimated using a scanner, which can scan an opening of the bucket and determine a material volume inside the bucket. The weight of the material can be estimated by multiplying the material volume by an estimated bulk density of the material. In certain exemplary embodiments, the material volume in the bucket can be estimated based upon a scanned three-dimensional model of the bank and a depth of the bucket in the bank during digging based on a trajectory of the bucket. The weight of the material can be estimated by multiplying the material volume by an estimated bulk density of the material.

Certain exemplary embodiments can provide a method adapted to position the mining excavator in front of the bank. The method can provide a plurality of activities that can comprise automatically determining a profile of a bank digging surface as two-dimensional and/or three-dimensional model. The method can comprise automatically estimating a desired location of the mining excavator relative to the bank. The method can comprise automatically calculating a mathematical representation and trajectory of the bucket of the mining excavator to engage the bank during digging. A profile of the bank can be established using two scanners mounted in a frontal portion of the mining excavator. As the mining excavator turns towards the bank such scanners can establish a three-dimensional model of the bank and/or provide information about the distance of the mining excavator from the bank. Based on possible trajectories the shovel bucket can take, a desired distance for crawlers of the mining excavator can be calculated and the operator can be automatically prompted to relocate the mining excavator to a desired location. With the mining excavator in the desired location, in certain exemplary mines, the mining excavator can dig a sufficient number of passes to load approximately three trucks (e.g., nine passes). In certain exemplary embodiments, a known three-dimensional profile of the bank and a known trajectory of the bucket can also be used to automate a digging motion by automatically controlling both hoist and crowd motion.

Certain exemplary embodiments can provide a method for a relatively rapid transfer between hoist and propel motions. The method can provide a plurality of activities that can comprise utilizing electrically operated switches (contactors), such as to replace mechanically operated switches (where a motor closes a switch at one or another position ). Certain exemplary embodiments can utilize two dedicated propel inverters configured such that a transfer between hoist and propel can be eliminated.

Certain exemplary embodiments can provide a method of relatively efficient truck placement for loading via the mining excavator. This method can provide a plurality of activities that can comprise providing a signal to the truck operator regarding how to move the mining haulage vehicle into a desired location for loading. In certain exemplary embodiments, the operator can be signaled based on a GPS location of the mining excavator, a GPS location of the mining haulage vehicle, and/or a calculated trajectory of the bucket anticipated to position the bucket over a dump body of the mining haulage vehicle. In certain exemplary embodiments, a short wave radar system on the mining excavator and/or on the mining haulage vehicle can indicate a desired location of the mining haulage vehicle to the operator.

Certain exemplary embodiments can provide a method of automatic swinging and positioning of the bucket to load the mining haulage vehicle. This method can provide a plurality of activities that can comprise scanning the truck and the dump body during placement of a first bucket load and storing placement information in a memory. As additional bucket loads are placed in the mining haulage vehicle, a swing motion control of the bucket can be governed by a superimposed position control loop that can accelerate and/or decelerate the bucket to a desired position over the dump body of the mining haulage vehicle.

Certain exemplary embodiments can provide an operator training simulator that embodies one or more functions of the exemplary embodiments described herein. Using the simulator, operator reactions can be compared to predetermined desired reactions. Improvement in operator reactions can be monitored and/or recorded by the simulator.

FIG. 1 is a block diagram of an exemplary embodiment of a system 1000, which can comprise mining excavators, such as mining excavator 1100, mining excavator 1200, and mining excavator 1300. In embodiments related to excavation, mining excavators 1100, 1200, and/or 1300 can comprise excavators, backhoes, front-end loaders, mining shovels, and/or electric mining shovels, etc. Each of mining excavators

1100, 1200, and/or 1300 can comprise a wired communication interface, a wireless receiver, and/or a wireless transceiver. The wireless receiver can be adapted to receive GPS information from a GPS satellite. The wired interface and/or the wireless transceiver can be adapted to send and/or receive information from a plurality of machines, sensors, and/or information devices directly and/or via a wireless communication tower 1500.

Mining excavators 1100, 1200, and/or 1300 can be adapted to load a mining haulage vehicle 1400. Mining haulage vehicle 1400 can be a fossil fuel powered mining haul truck, electric mining haul truck, rail car, flexible conveyor train, in-pit crushing hopper, and/or truck with an open bed trailer, etc. Mining haulage vehicle 1400 can be adapted to receive earthen material from mining excavators 1100, 1200, and/or 1300 that was obtained from an earthen material bank. Mining haulage vehicle 1400 can be adapted to directly and/or wirelessly communicate with mining excavators 1100, 1200, and/or 1300 directly and/or via communication tower 1500. Mining haulage vehicle 1400 can receive instructions for movement and activities from an information device such as information device 1650 and/or an information device comprised by one or more of mining excavators 1100, 1200, and/or 1300.

Each of mining excavators 1100, 1200, and/or 1300 can comprise a bucket excavation controller, which can be adapted to; responsive to an automatically detected stall condition at a hoist motor of mining excavators 1100, 1200, and/or 1300; automatically control a crowd motion of mining excavators 1100, 1200, and/or 1300. The crowd motor can be adapted to adjust a position of a bucket of mining excavators 1100, 1200, and/or 1300 in earthen material banks.

System 1000 can comprise a vehicle 1450, which can relate to operation and/or maintenance of mining excavators 1100, 1200, and/or 1300. For example, vehicle 1450 can be associated with a management entity responsible for monitoring performance of mining excavators 1100, 1200, and/or 1300.

System 1000 can comprise a plurality of networks, such as a network 1600, a network 1700, a network 1900, and a network 1950. Each of networks 1600, 1700, 1900, and/or 1950 can communicatively couple information devices to mining excavators 1100, 1200, and/or 1300 directly and/or via wireless communication tower 1500. A wireless transceiver 1625 can communicatively couple wireless communication tower 1500 to information devices coupled via network 1600.

Network 1600 can comprise a plurality of communicatively coupled information devices such as a server 1650. Server 1650 can be adapted to receive, process, and/or store information relating to mining excavators 1100, 1200, and/or 1300. Network 1600 can be communicatively coupled to network 1700 via a server 1675. Server 1675 can be adapted to provide files and/or information sharing services between devices coupled via networks 1600 and/or 1700. Network 1700 can comprise a plurality of communicatively coupled information devices, such as information device 1725.

Network 1700 can be communicatively coupled to network 1900 and network 1950 via a firewall 1750. Firewall 1750 can be adapted to restrict access to networks 1600 and/or 1700. Firewall 1750 can comprise hardware, firmware, and/or software. Firewall 1750 can be adapted to provide access to networks 1600 and/or 1700 via a virtual private network server 1725. Virtual private network server 1725 can be adapted to authenticate users and provide authenticated users, such as an information device 1825, an information device 1925, and an information device 1975, with a communicative coupling to mining excavators 1100, 1200, and/or 1300.

Virtual private network server 1725 can be communicatively coupled to the Internet 1800. The Internet 1800 can be communicatively coupled to information device 1825 and networks 1900 and/or 1950. Network 1900 can be communicatively coupled to information device 1925. Network 1975 can be communicatively coupled to information device 1975.

Figure 2:
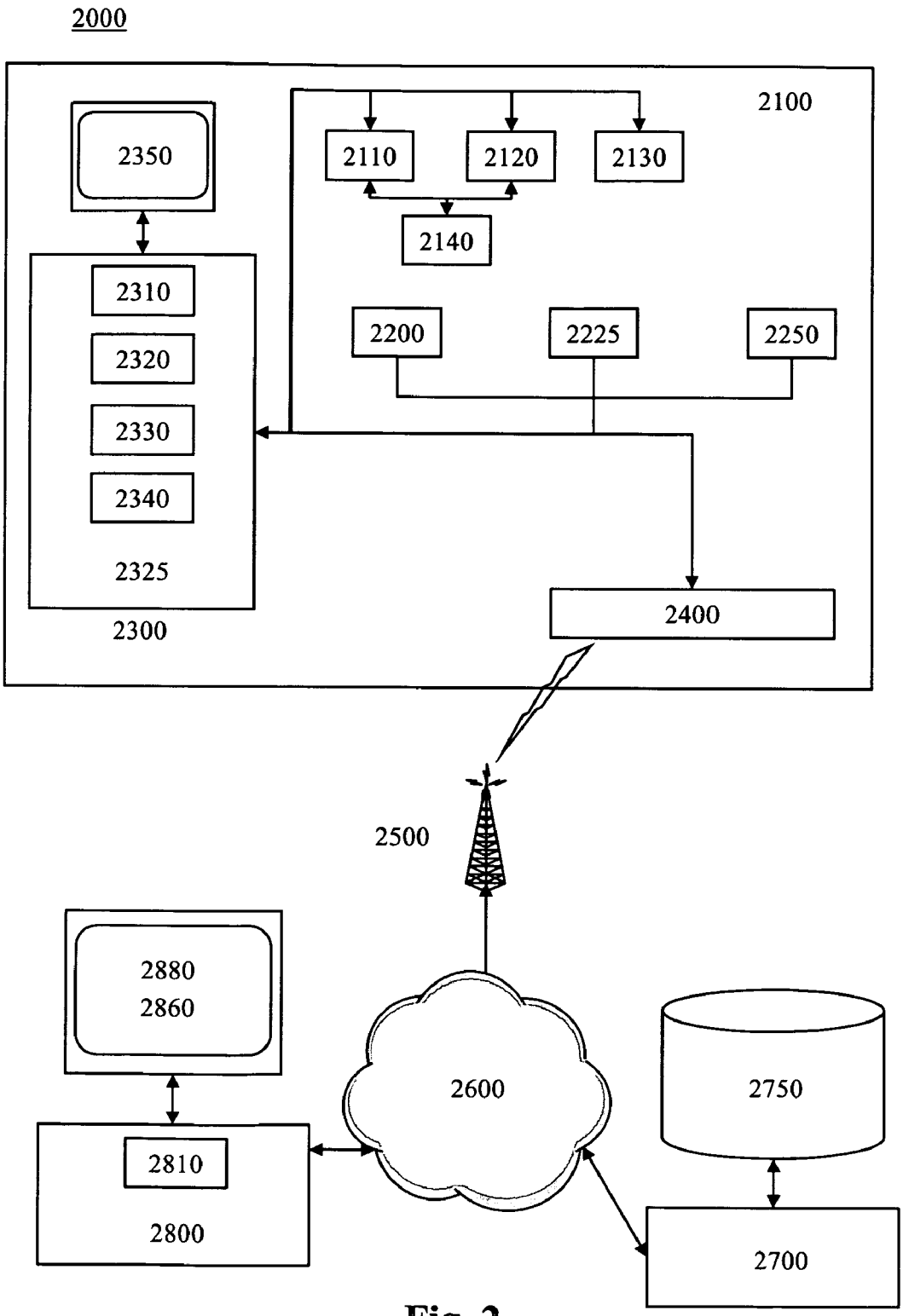
FIG. 2 is a block diagram of an exemplary embodiment of a system 2000.

FIG. 2 is a block diagram of an exemplary embodiment of a system 2000, which can comprise a mining excavator 2100. Mining excavator 2100 can be powered by one or more diesel engines, gasoline engines, and/or electric motors, etc. Mining excavator 2100 can comprise a plurality of sensors, such as a sensor 2200, a sensor 2225, and a sensor 2250. Sensors 2200, 2225, and/or 2250 can be adapted to measure pressure, temperature, flow, mass, heat, light, sound, humidity, proximity, position, velocity, vibration, voltage, current, torque, capacitance, resistance, inductance, and/or electromagnetic radiation, etc. Sensors 2200, 2225, and/or 2250 can be communicatively coupled to an information device 2300 comprised in mining excavator 2100, a wired network interface, and/or a wireless transceiver 2400.

Information device 2300 can comprise a user interface 2350 and a client program 2325. In certain exemplary embodiments, information device 2300 can be adapted to provide, receive, and/or execute a digging routine related to machine 2100. Information device 2300 can be communicatively coupled to a memory device adapted to store programs and/or information related to machine 21 00.

Information device 2300 can comprise a bucket excavation controller 2310, which can be adapted to, responsive to an automatically detected stall condition at a hoist motor 2110 of mining excavator 2100, automatically control a crowd motor 2120 of mining excavator 2100. The stall condition can be detected based upon a deviation between a desired speed of hoist motor 2110 and the speed of hoist motor 2110. The stall condition can be detected based upon a determination that the speed of hoist motor 2110 is below a predetermined threshold and a hoist torque of hoist motor 2110 is above a predetermined threshold. Crowd motor 2120 can be adapted to adjust a position of a bucket 2140 of mining excavator 2100 in an earthen material bank. Bucket excavation controller 2310 can be adapted to, responsive to an automatic determination that a speed of hoist motor 2110 exceeds a predetermined threshold, automatically control crowd motor 2120 to adjust the position of bucket 2140 in the earthen material bank.

Information device 2300 can comprise a material weight processor 2320, which can be adapted to determine a total torque used to hoist bucket 2140 through the earthen material bank. Material weight processor 2320 can be adapted to determine a weight of earthen material in bucket 2140 based upon the total torque. Material weight processor 2320 can be adapted to estimate a weight of earthen material in bucket 2140 while bucket 2140 is digging in the earthen material bank based upon a detected volume of earthen material in bucket 2140.

Information device 2300 can comprise a mining haulage vehicle position processor 2330, which can be adapted to automatically determine a desired location of a mining haulage vehicle relative to mining excavator 2100. Mining haulage vehicle position processor 2330 can be adapted to automatically prompt an operator of the mining haulage vehicle regarding the desired location of the mining haulage vehicle relative to mining excavator 2100. Mining haulage vehicle position processor 2330 can be adapted to, based upon a received scan of a bed of the mining haulage vehicle, automatically determine a desired location of bucket 2140 relative to the bed of the mining haulage vehicle.

Information device 2300 can comprise a mining haulage vehicle load processor 2340, which can be adapted to, based upon a received scan of a bed of a mining haulage vehicle; automatically determine a desired location of bucket 2140 relative to the bed of the mining haulage vehicle. Mining haulage vehicle load processor 2340 can be adapted to, based upon a received scan of a bed of a mining haulage vehicle, automatically swing bucket 2140 to load the mining haulage vehicle. Any function performed by information device 2300 and/or the components thereof can be performed via an information device located remotely from mining excavator 2100. For example, in certain exemplary embodiments, information device 2800 can perform the functions enumerated herein as being performed by information device 2300 and/or performed in method 4000 of FIG. 4.

Wireless transceiver 2400 can be communicatively coupled to a network 2600 via a wireless tower 2500. Network 2600 can be adapted to communicatively couple information devices that communicate via various wireline or wireless media, such as cables, telephone lines, power lines, optical fibers, radio waves, light beams, etc. Network 2600 can be communicatively coupled to a server 2700, which can comprise a memory device 2750. Memory device 2750 can be adapted to store information regarding mining excavator 2100. The information stored in memory device 2750 can comprise information regarding operation and/or maintenance of mining excavator 2750, such as information from sensors 2200, 2225, and/or 2250.

Network 2600 can comprise an information device 2800. Information device 2800 can comprise a mining excavation simulator 2860 and a user interface 2880. In certain exemplary embodiments, mining excavation simulator 2860 can be adapted to render a simulated mining excavator. Mining excavation simulator 2860 can be adapted to, responsive to an automatically detected stall condition at a simulated hoist motor of a simulated mining excavator, automatically control a simulated crowd motor of the simulated mining excavator. The simulated crowd motor can be adapted to adjust a position of a simulated bucket of the simulated mining excavator in a simulated earthen material bank. Mining excavation simulator 2860 can be adapted to, responsive to an automatic determination that a speed of the hoist motor exceeds a predetermined threshold, automatically control the simulated crowd motor to adjust the position of the simulated bucket in the simulated earthen material bank. Mining excavation simulator 2860 can be adapted to simulate any mining excavator function and/or movement described herein. Mining excavation simulator 2860 can be adapted to train an operator of a mining excavator to improve performance of the operator regarding an actual mining excavator.

Figure 3:
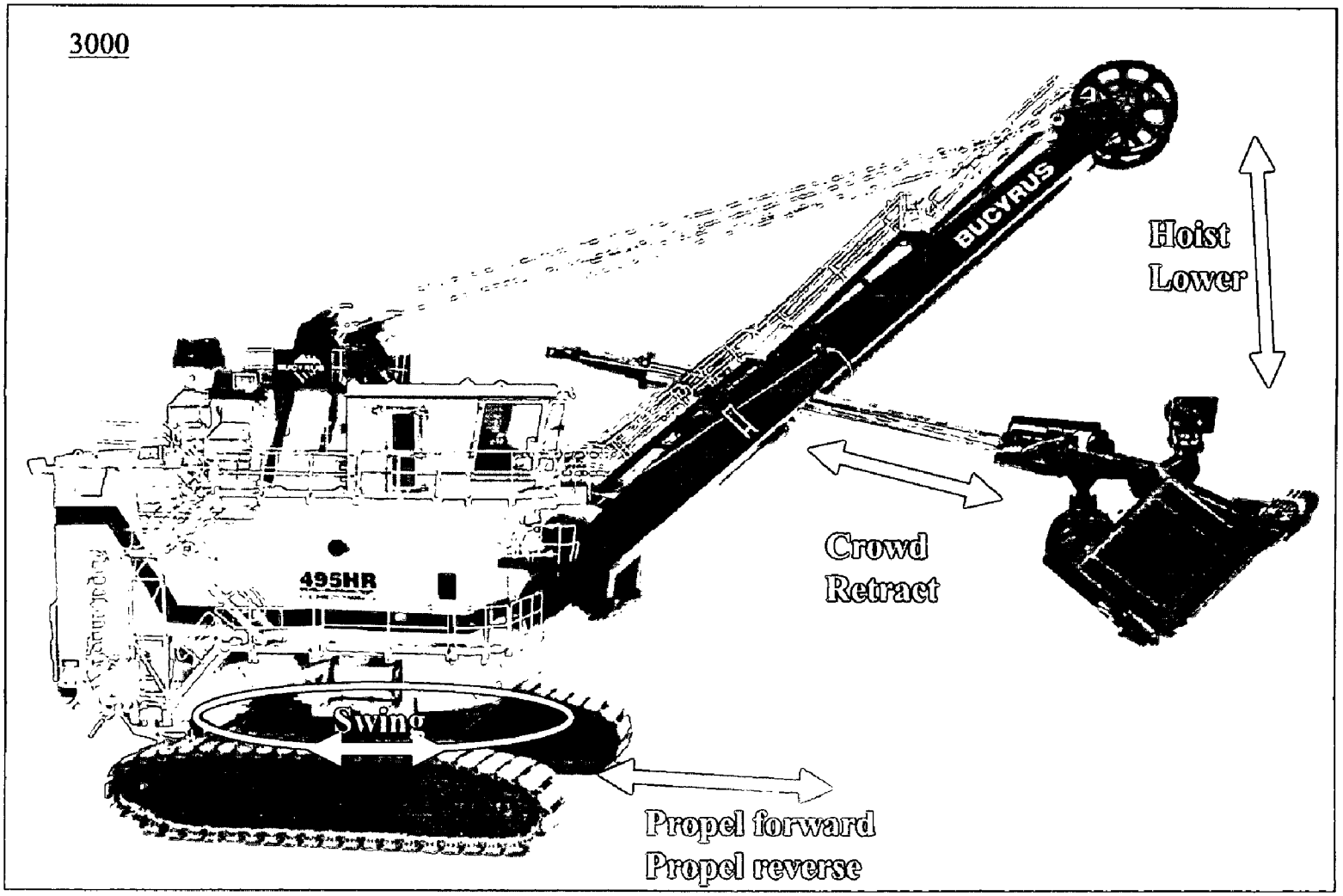
FIG. 3 is a perspective view of an exemplary embodiment of a mining shovel 3000.

FIG. 3 is a perspective view of an exemplary embodiment of a mining shovel 3000, which can comprise a machinery house. The machinery house can hold electric drives and/or mechanical gears to operate the motions hoist, crowd, swing, and/or propel motions. The electric drives can be adapted to move a boom, bucket, and/or crawlers of the mining shovel. Mining shovel 3000 can hoist (i.e., lifts and lower the bucket), crowd (i.e., crowd out and/or retract the bucket so that it can engage and dig in the bank), swing (i.e., turn a mobile portion of the shovel clockwise and counter clockwise around a center of the shovel), and/or be propelled (i.e., mining shovel 3000 can be propelled translationally, in forward and/or reverse directions, with the crawlers). Mining shovel 3000 can be steered via a variation of crawler speeds.

Figure 6:
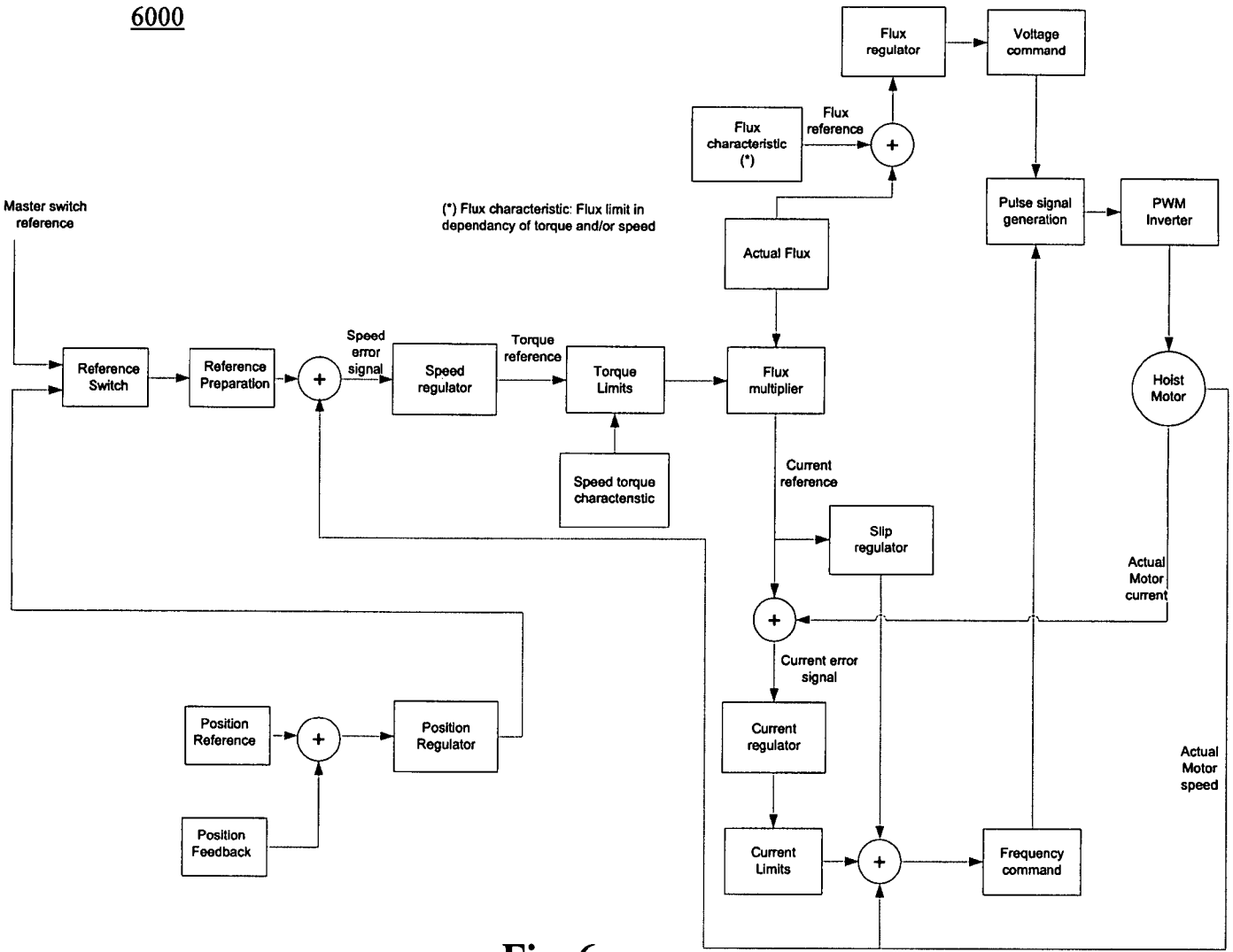
FIG. 6 is a flowchart of an exemplary embodiment of a method 6000.

FIG. 6 is a flowchart of an exemplary embodiment of a method 6000. Certain exemplary embodiments can monitor and/or control a hoist motion with a superimposed position control loop that comprises a position reference and feedback value. The position reference of the Hoist can be given as a function of a surface grade in front of the mining shovel and a digging start point, which can be determined based on the intended trajectory of the bucket.

Figure 7:
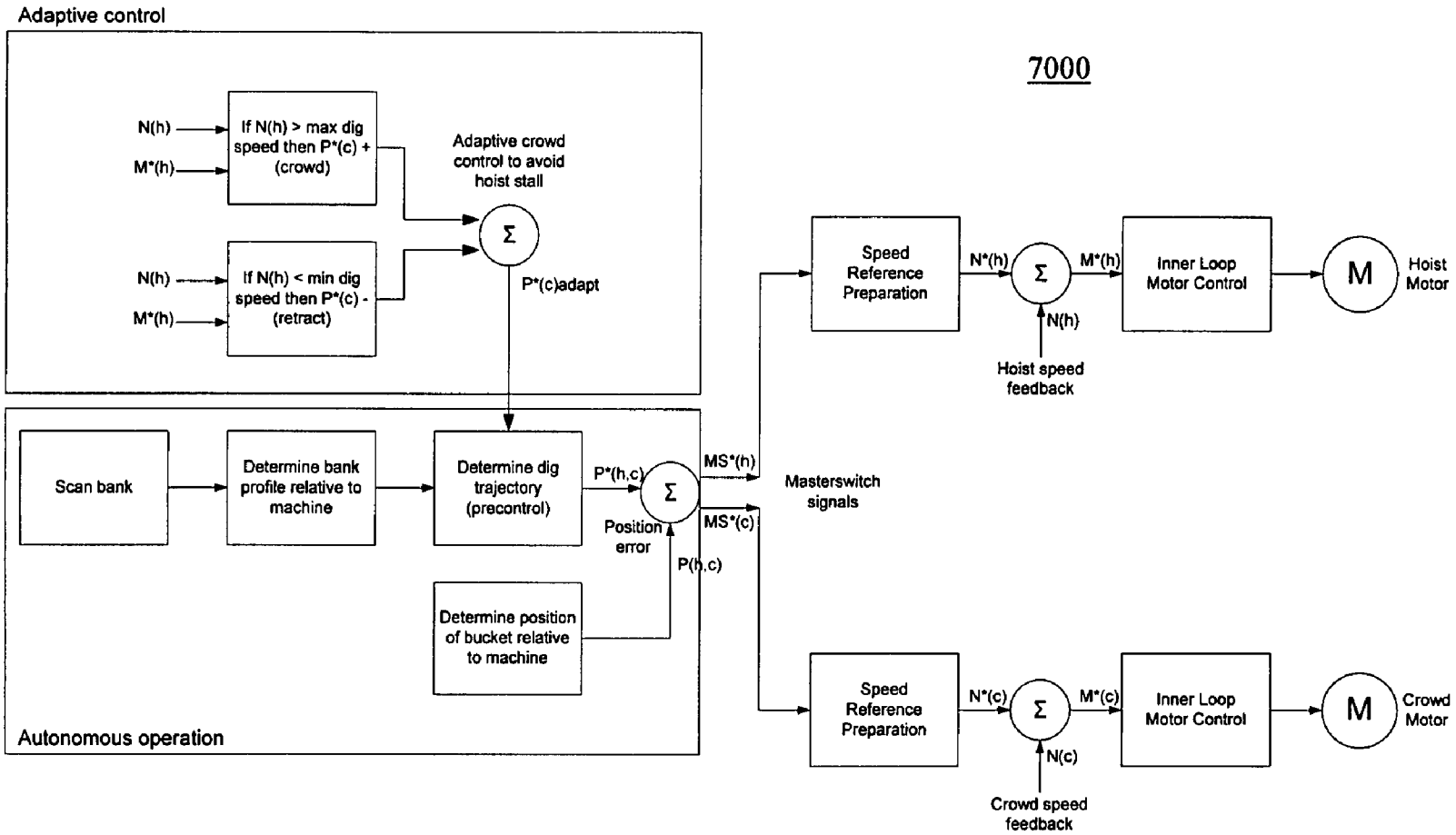
FIG. 7 is a flowchart of an exemplary embodiment of a method 7000.

FIG. 7 is a flowchart of an exemplary embodiment of a method 7000, which can be adapted to perform adaptive control to avoid a stall during digging. Method 7000 can also comprise autonomous control to control hoist and/or crowd motions during digging without an operator and/or operator intervention. Certain exemplary embodiments can be indicative of a crowd motion with a super imposed anti-stall control loop. The position of the bucket relative to a surface of a sloped bank can be adjusted via control of the crowd motion by a crowd motor. As the bucket is raised in a digging motion, stall conditions can be automatically detected and the crowd can be adjusted away from the bank to reduce resistance from digging.

Figure 8:
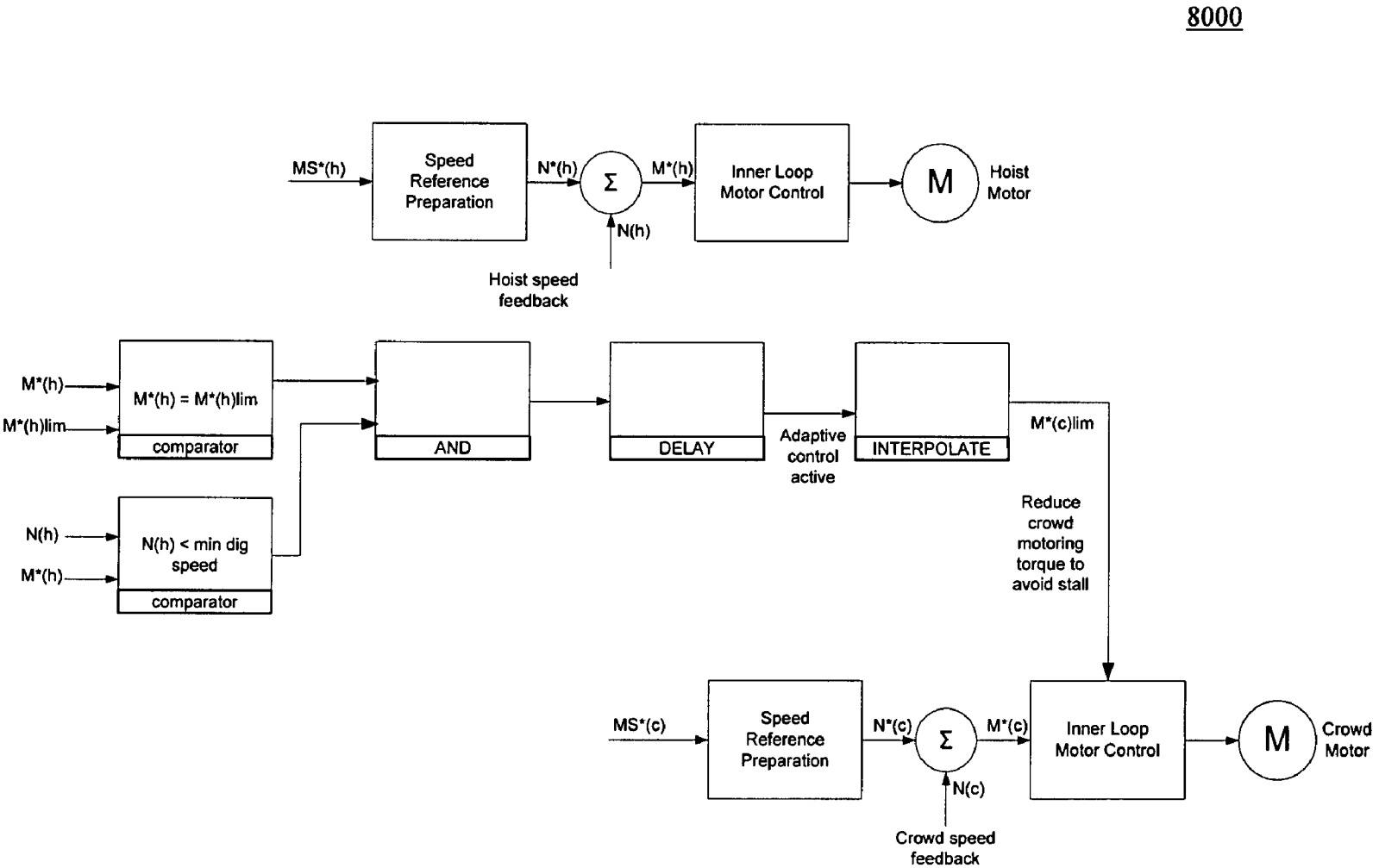
FIG. 8 is a flowchart of an exemplary embodiment of a method 8000.

FIG. 8 is a flowchart of an exemplary embodiment of a method 8000, which can be adapted to perform adaptive control of crowd motion torque to avoid a stall during digging. In the illustrated embodiment, the symbol (h) means hoist and the symbol (c) means crowd.

Figure 9:
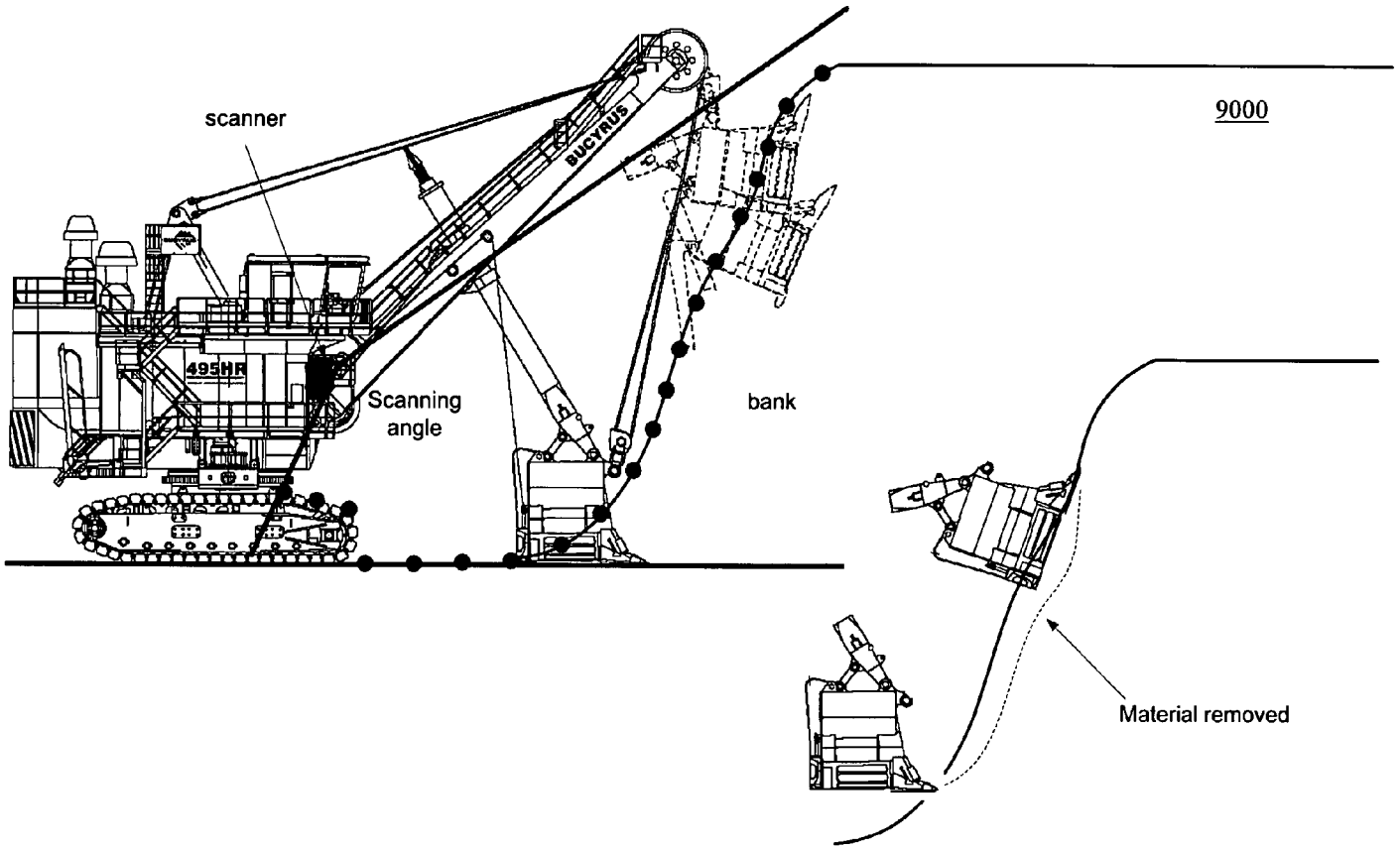
FIG. 9 is a block diagram of an exemplary embodiment of a system 9000.

FIG. 9 is a block diagram of an exemplary embodiment of a system 9000, which can be adapted to estimate a weight of earthen material in a bucket based upon a determined volume removed from an earthen bank.

Figure 10:
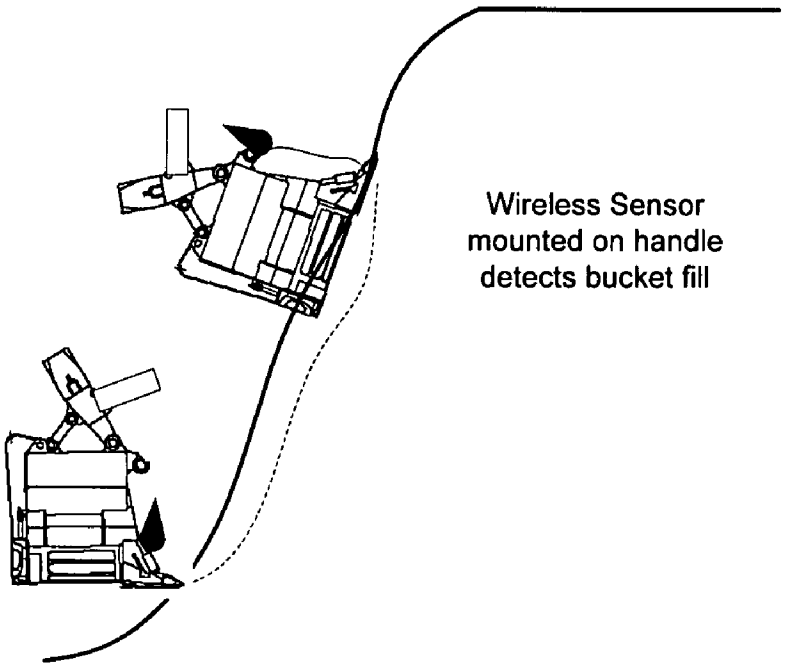
FIG. 10 is a block diagram of an exemplary embodiment of a system 10000.

FIG. 10 is a block diagram of an exemplary embodiment of a system 10000. In certain exemplary embodiments, a weight of earthen material in a bucket of the shovel can be determined based upon a determined bank profile, a depth of the bucket in the bank, and/or an estimated bulk density of material in the bucket. In certain exemplary embodiments, a weight of earthen material in a bucket of the shovel can be determined based upon a scan of an inside of the bucket from a scanning device. Certain exemplary embodiments can determine whether certain "bucket filling marks" inside the bucket are covered or not. Filling marks can be used to provide an estimate of a volume of earthen material in the bucket. A weight of material in the bucket can be determined based upon the estimated volume of earthen material and the estimated bulk density of the earthen material.

Figure 11:
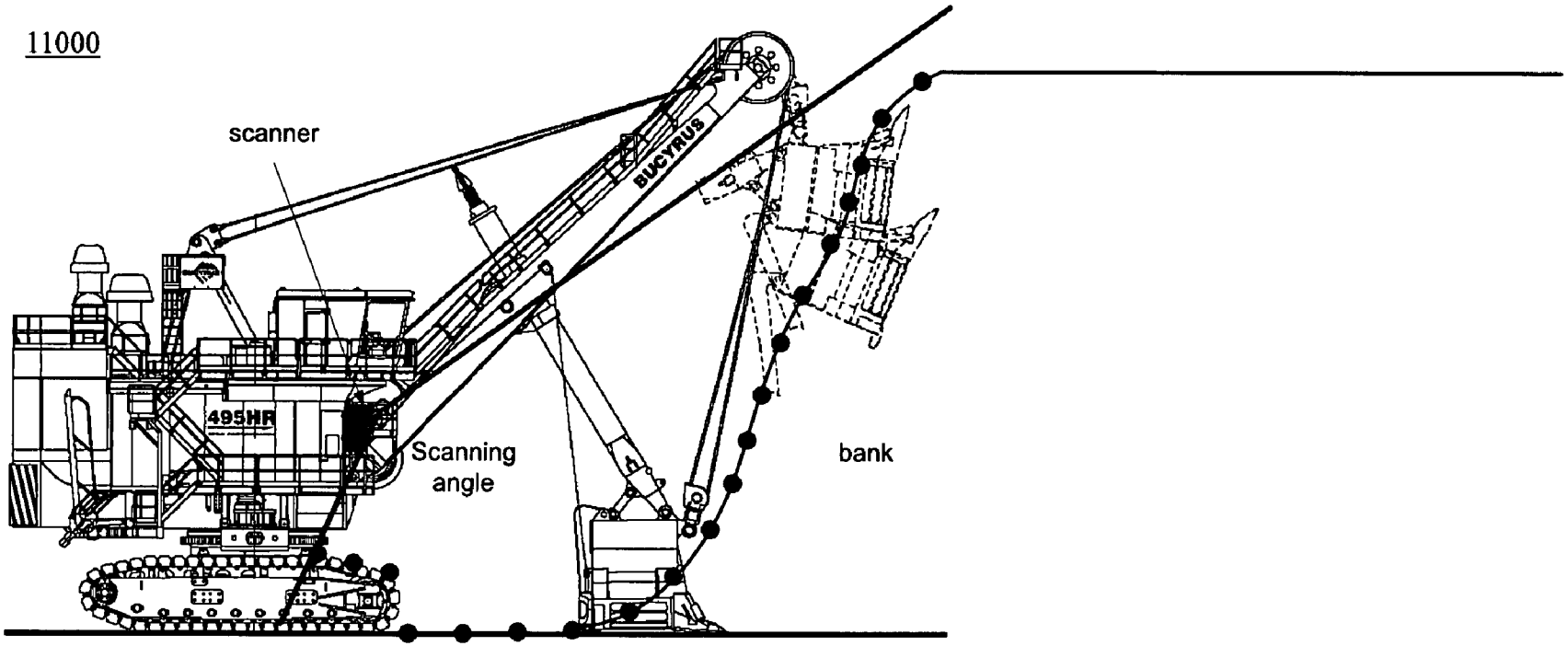
FIG. 11 is a block diagram of an exemplary embodiment of a system 11000.

FIG. 11 is a block diagram of an exemplary embodiment of a system 11000. Certain exemplary embodiments can use mining excavator mounted scanning devices to determine and/or provide a three-dimensional model of the bank in front of the mining excavator. The model can comprise information about a distance of each measured point of the bank from the mining excavator. Certain exemplary embodiments can consider the model of the bank along with known possible trajectories of the bucket going up from a digging start point through the bank allow calculation of an preferred distance between the mining excavator and bank for digging.

Figure 12:
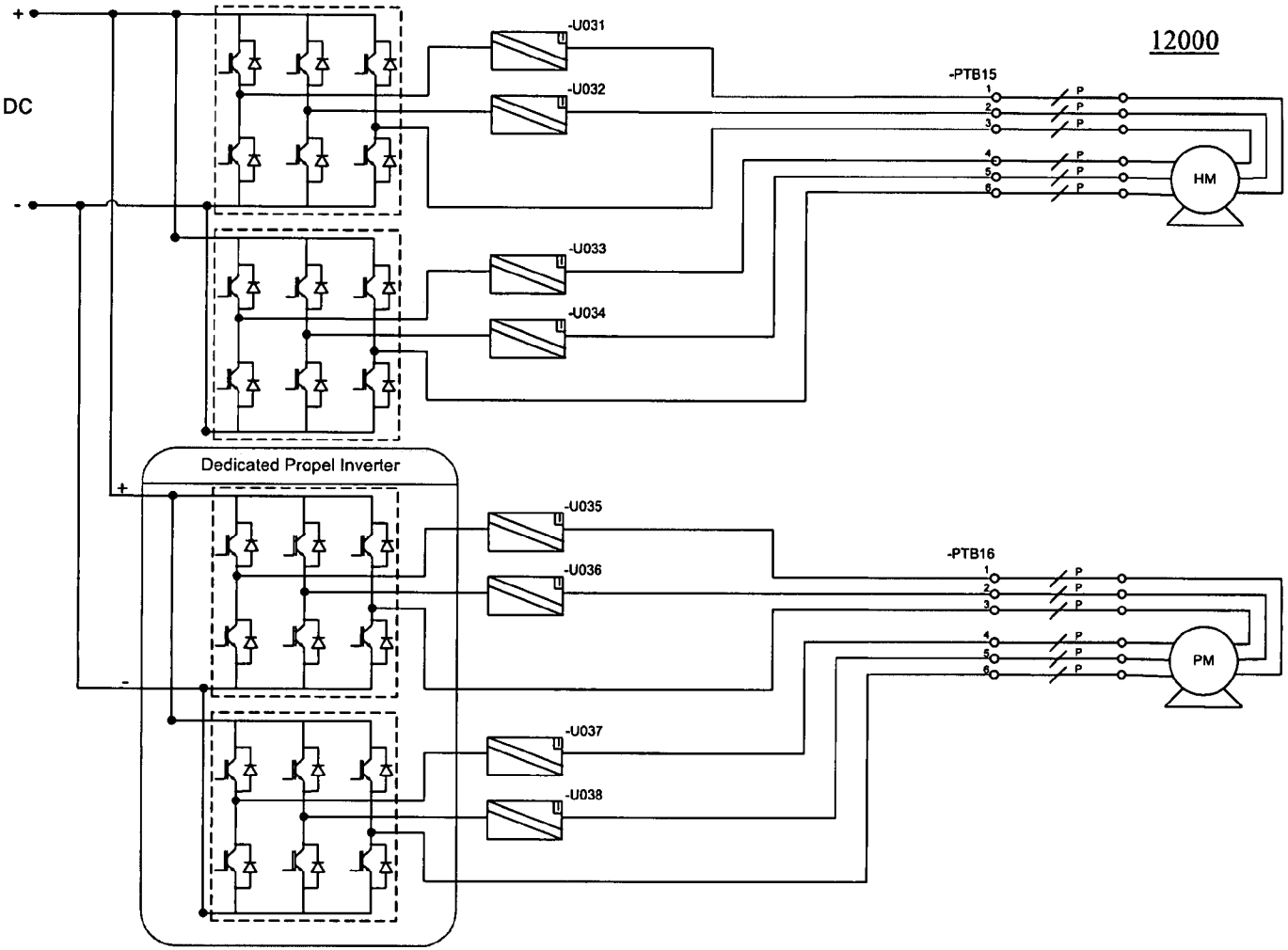
FIG. 12 is a block diagram of an exemplary embodiment of a system 12000.

FIG. 12 is a block diagram of an exemplary embodiment of a system 12000, which can comprise a dedicated propel inverter. Certain exemplary embodiments can attempt to reduce transfer time between hoist and propel motions of a mining excavator. In certain exemplary embodiments, an electrical drive system of the hoist motion can also be used to power the propel motion. In such embodiments, the drive system can be turned off, the power connections can be switched from one set of motors to another, and the drive system can be turned on again. A transfer time for performing such activities can influence productivity of the mining excavator.

Figure 13:
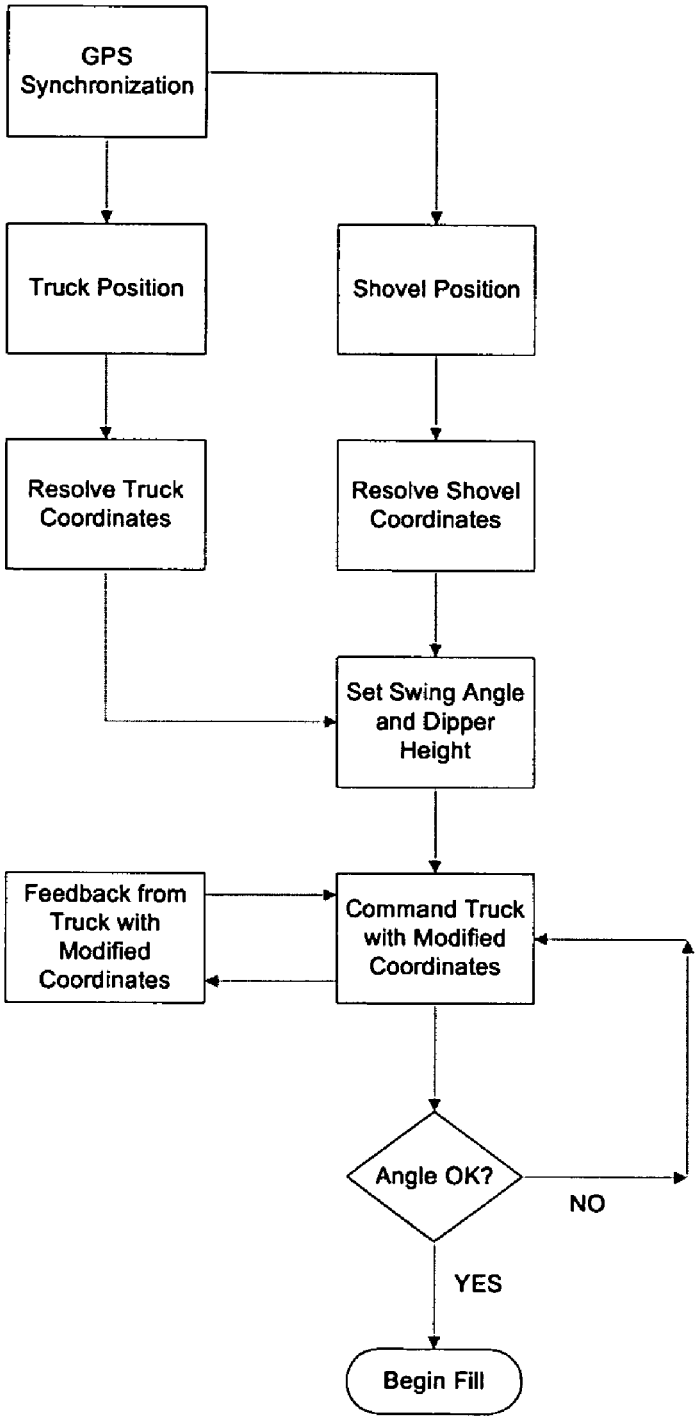
FIG. 13 is a flowchart of an exemplary embodiment of a method 13000.

FIG. 13 is a flowchart of an exemplary embodiment of a method 13000, which can be adapted to provide a relatively effective and/or efficient placement of a mining haulage vehicle relative to a mining excavator.

Figure 14:
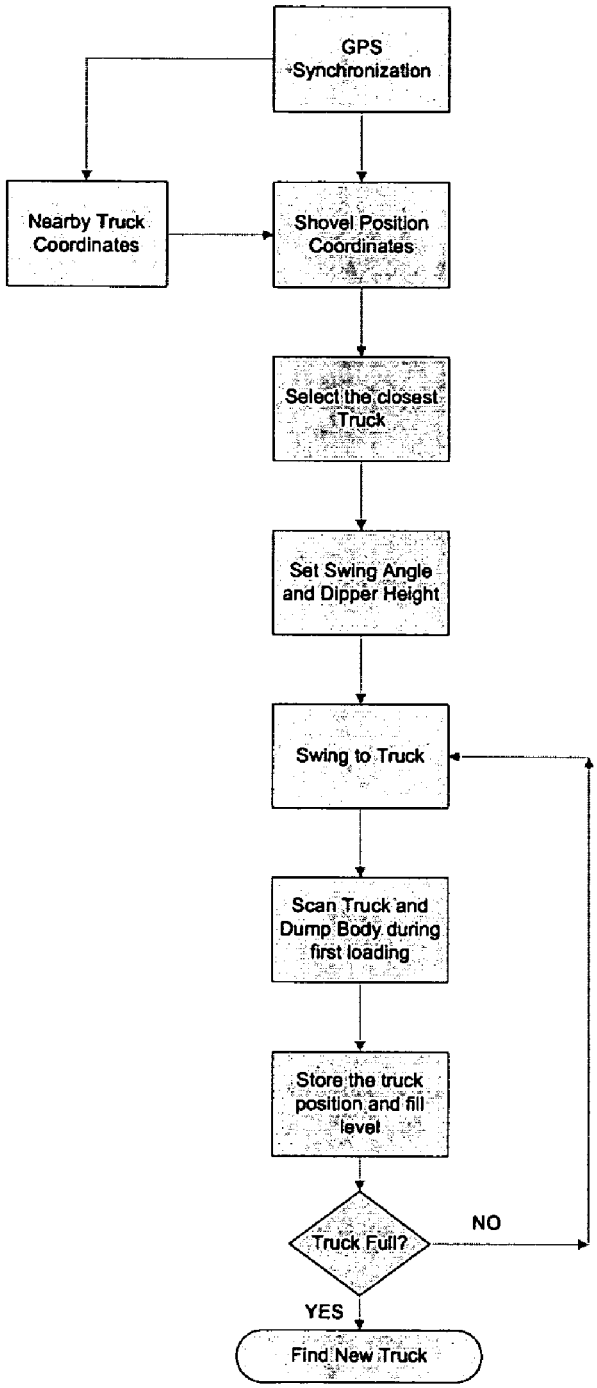
FIG. 14 is a flowchart of an exemplary embodiment of a method 14000.

FIG. 14 is a flowchart of an exemplary embodiment of a method 14000, which can be adapted to provide for a relatively effective and/or efficient swing operation for a bucket of the mining excavator in loading a mining haulage vehicle.

Figure 4:
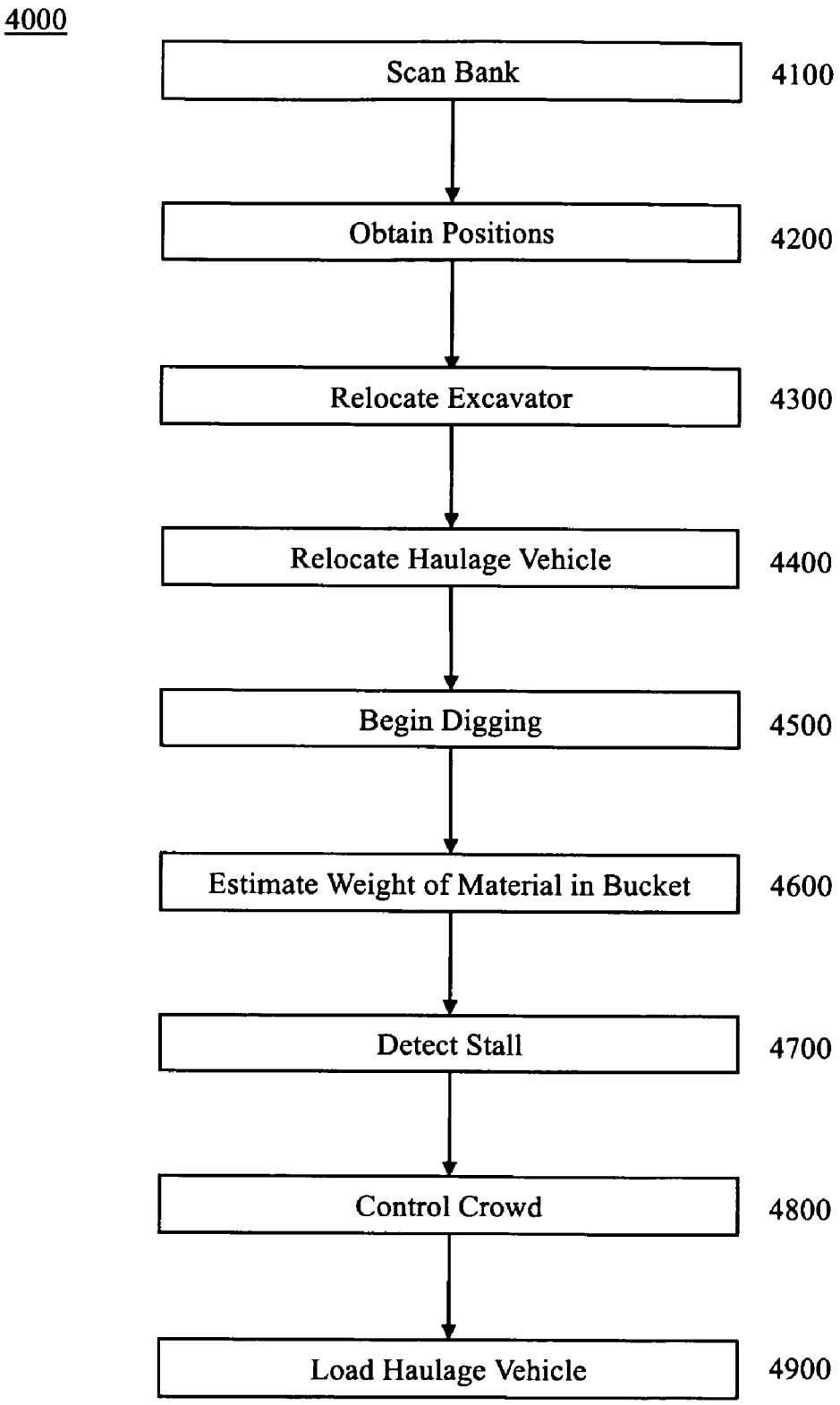
FIG. 4 is a flowchart of an exemplary embodiment of a method 4000.

FIG. 4 is a flowchart of an exemplary embodiment of a method 4000. Activities of method 4000 can be performed automatically. In certain exemplary embodiments, machine instructions adapted to perform any activity, or any subset of activities, of method 4000 can be stored on a machine-readable medium. At activity 4100, an earthen material bank can be scanned. The earthen material bank can be scanned with sensors such as laser sensors and/or radar sensors. Information from the sensors can be used to calculate and/or determine a two-dimensional and/or a three-dimensional model of the earthen material bank. The two-dimensional and/or a three-dimensional model of the earthen material bank can be used to automatically prompt operators of and/or automatically control a mining excavator and/or a mining haulage vehicle.

At activity 4200, positions and/or locations of the mining excavator and/or the mining haulage vehicle can be obtained. The positions and/or locations of the mining excavator and/or a mining haulage vehicle can be obtained via a GPS system and/or via sensors present in one or more of the mining excavator and/or the mining haulage vehicle (e.g., proximity sensors).

At activity 4300, the mining excavator can be relocated from a first location to a second location. For example, a relocation of the mining excavator can be automatically caused based upon an estimate of a count of mining haulage vehicle loads extractable from an earthen material bank at a preferred location. A bucket excavation controller of the mining excavator can be adapted to select the preferred location from a profile of the earthen material bank, measurements of the bank, measurements of the mining excavator, and/or a plurality of projected locations of the mining excavator. The preferred location can have a higher estimated count of extractable mining vehicle loads that any other of the plurality of projected locations. The preferred location can be established based upon a measurement of a laser sensor and/or a measurement of a radar sensor. Based upon a detected position of the mining excavator relative to the earthen material bank, the mining excavator can be automatically positioned.

At activity 4400, the mining haulage vehicle can be relocated from a first location to a second location. In certain exemplary embodiments, an operator of the mining haulage vehicle can be prompted regarding relocation of the mining haulage vehicle. In certain exemplary embodiments, an information device can be adapted to automatically cause the relocation of the mining haulage vehicle.

At activity 4500, the mining excavator can begin a digging cycle. The digging cycle can be automatically started at the preferred location. The position of the bucket of the mining excavator can be automatically established based upon an automatically detected profile of the earthen material bank at the preferred location.

At activity 4600, an estimate can be made of a weight of earthen material in the bucket of the mining excavator. Responsive to information obtained as the mining excavator is digging in an earthen material bank, the weight of the earthen material in a bucket of the mining excavator can be automatically estimated. In certain exemplary embodiments, the weight can be estimated based upon a torque of the hoist motor. In certain exemplary embodiments, the weight can be estimated based upon a scanned volume of earthen material in the bucket.

At activity 4700, a stall condition of the bucket of the mining excavator can be determined. The stall condition can be determined based upon a deviation of an actual hoist speed from a predetermined desired hoist speed. A torque of a motor driving the hoist can be considered in determining the stall condition. For example, a maximum motor torque in combination with a relatively low actual hoist speed as compared to the predetermined hoist speed can be indicative of the stall condition.

At activity 4800, a crowd motor of the mining excavator can be controlled. The crowd motor can be adapted to adjust a position of a bucket of the mining excavator in the earthen material bank. The mining excavator can comprise a processor and/or bucket excavation controller adapted to, responsive to the weight and an automatically detected stall condition at the hoist motor of the mining excavator, automatically control a crowd motion of the mining excavator. The crowd motor can be adapted to adjust a position of the bucket of the mining excavator in the earthen material bank at the preferred location.

At activity 4900, the mining haulage vehicle can be loaded with earthen material from the bucket of the mining excavator. In certain exemplary embodiments, a processor and/or controller associated with the mining excavator can automatically determine a location in a bed of the mining haulage vehicle that the earthen material should be placed. The processor and/or controller can be adapted to automatically prompt an operator regarding loading the mining haulage vehicle. In certain exemplary embodiments, the processor and/or controller can be adapted to automatically position the bucket of the mining excavator relative to the bed of the mining haulage vehicle in order to load the bed with the earthen material.

Figure 5:
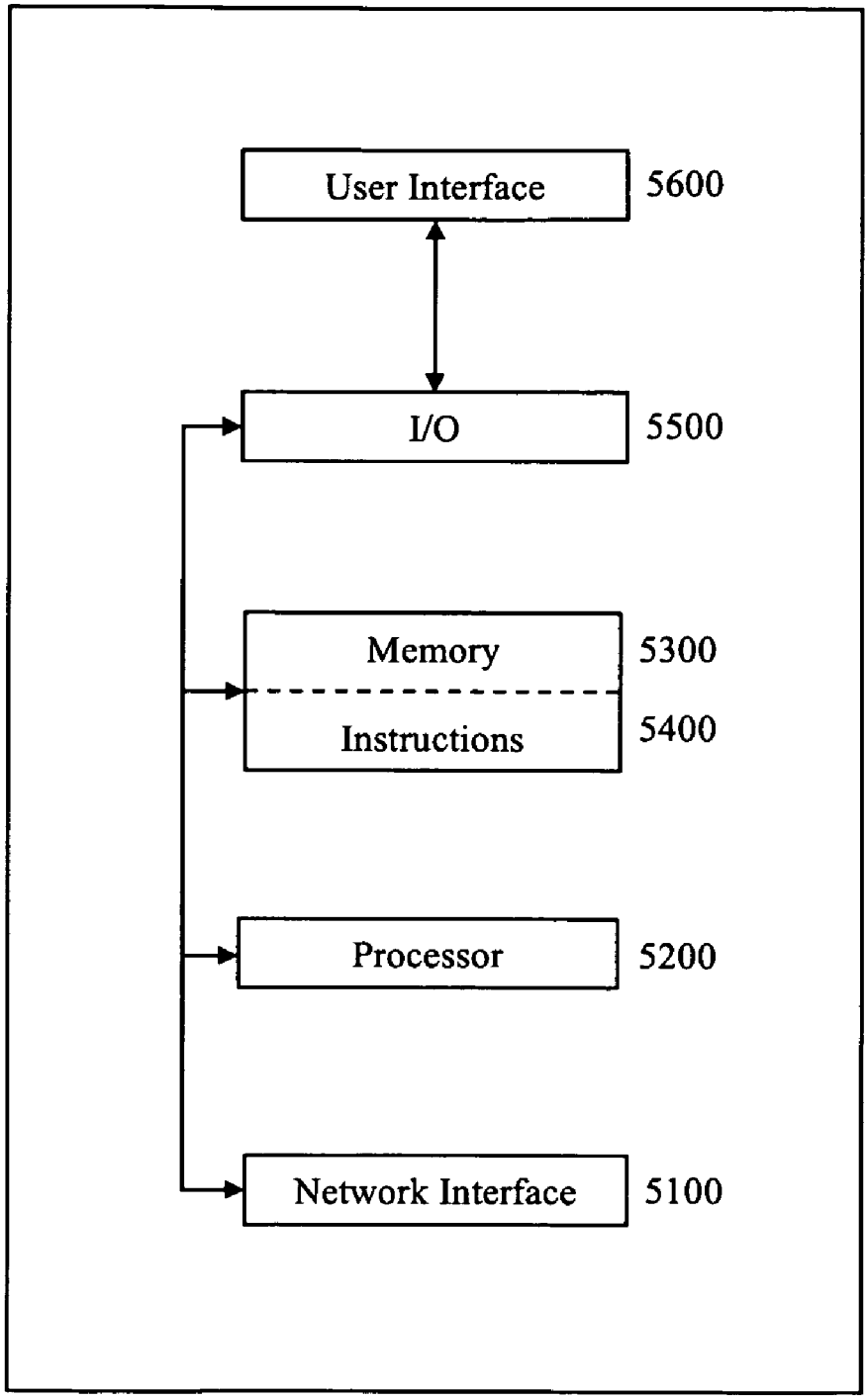
FIG. 5 is a block diagram of an exemplary embodiment of an information device 5000.

FIG. 5 is a block diagram of an exemplary embodiment of an information device 5000, which in certain operative embodiments can comprise, for example, information device 2300, information device 2800, and server 2700 of FIG. 2. Information device 5000 can comprise any of numerous circuits and/or components, such as for example, one or more network interfaces 5100, one or more processors 5200, one or more memories 5300 containing instructions 5400, one or more input/output (I/O) devices 5500, and/or one or more user interfaces 5600 coupled to I/O device 5500, etc.

In certain exemplary embodiments, via one or more user interfaces 5600, such as a graphical user interface, a user can view a rendering of information related to mining, researching, designing, modeling, creating, developing, building, manufacturing, operating, maintaining, storing, marketing, selling, delivering, selecting, specifying, requesting, ordering, receiving, returning, rating, and/or recommending any of the products, services, methods, and/or information described herein.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

above—at a higher level.

access—(n) a permission, liberty, right, mechanism, or ability to enter, approach, communicate with and/or through, make use of, and/or pass to and/or from a place, thing, and/or person; (v) to enter, approach, communicate with and/or through, make use of, and/or pass to and/or from.

activity—an action, act, deed, function, step, and/or process and/or a portion thereof.

adapted to—suitable, fit, and/or capable of performing a specified function.

adjust—to change, modify, adapt, and/or alter.

and/or—either in conjunction with or in alternative to.

any other—whatever alternatives exist.

apparatus—an appliance and/or device for a particular purpose.

automatically—acting and/or operating in a manner essentially independent of external human influence and/or control. For example, an automatic light switch can turn on upon "seeing" a person in its view, without the person manually operating the light switch.

bank—a sloped earthen surface.

based upon—determined in consideration of and/or derived from.

bed—a part of a truck, trailer, or freight car designed to carry loads.

begin—to start.

below—beneath; in a lower place; and/or less than.

between—in a separating interval and/or intermediate to.

bucket—a receptacle on an excavating machine adapted to dig, hold, and/or move material such as excavated earth.

bucket excavation controller—a device and/or system adapted to regulate one or more digging activities of a mining excavator.

cable—an insulated conductor adapted to transmit electrical energy.

cable reel—a spool adapted to feed or retract an electrical cable.

can—is capable of, in at least some embodiments.

cause—to bring about, provoke, precipitate, produce, elicit, be the reason for, result in, and/or effect.

circuit—an electrically conductive pathway and/or a communications connection established across two or more switching devices comprised by a network and between corresponding end systems connected to, but not comprised by the network.

communicate—to exchange information.

communicative coupling—linking in a manner that facilitates communications.

comprise—to include, but not be limited to, what follows.

configure—to design, arrange, set up, shape, and/or make suitable and/or fit for a specific purpose.

control—(n) a mechanical or electronic device used to operate a machine within predetermined limits; (v) to exercise authoritative and/or dominating influence over, cause to act in a predetermined manner, direct, adjust to a requirement, and/or regulate.

controller—a device and/or set of machine-readable instructions for performing one or more predetermined and/or user-defined tasks. A controller can comprise any one or a combination of hardware, firmware, and/or software. A controller can utilize mechanical, pneumatic, hydraulic, electrical, magnetic, optical, informational, chemical, and/or biological principles, signals, and/or inputs to perform the task(s). In certain embodiments, a controller can act upon information by manipulating, analyzing, modifying, converting, transmitting the information for use by an executable procedure and/or an information device, and/or routing the information to an output device. A controller can be a central processing unit, a local controller, a remote controller, parallel controllers, and/or distributed controllers, etc. The controller can be a general-purpose microcontroller, such the Pentium IV series of microprocessor manufactured by the Intel Corporation of Santa Clara, Calif. and/or the HC08 series from Motorola of Schaumburg, Ill. In another embodiment, the controller can be an Application Specific Integrated Circuit (ASIC) or a Field Programmable Gate Array (FPGA) that has been designed to implement in its hardware and/or firmware at least a part of an embodiment disclosed herein.

corresponding—related, associated, accompanying, similar in purpose and/or position, conforming in every respect, and/or equivalent and/or agreeing in amount, quantity, magnitude, quality, and/or degree.

count—(n.) a number reached by counting and/or a defined quantity. (v.) to increment, typically by one and beginning at zero.

crowd—(n.) a sub-system of a mining excavator that causes a bucket of the mining excavator to move into and/or away from a digging surface; (v.) to press, cram, and/or force a bucket of a mining excavator into the digging surface.

cycle—a set of predetermined activities.

data—information represented in a form suitable for processing by an information device.

define—to establish the meaning, relationship, outline, form, and/or structure of, and/or to precisely and/or distinctly describe and/or specify.

desired—indicated, expressed, and/or requested.

detect—to sense, perceive, identify, discover, ascertain, respond to, and/or receive the existence, presence, and/or fact of.

determine—to obtain, calculate, decide, deduce, establish, and/or ascertain.

deviation—a variation relative to a standard, expected value, and/or expected range of values.

device—a machine, manufacture, and/or collection thereof.

digging—excavating and/or scooping.

digging library—a plurality of procedures and/or heuristic rules regarding digging procedures.

digging procedure—a sequence of steps and/or activities for removing material from an earthen surface.

digging surface—an earthen surface prepared for material removal.

earthen—related to the earth.

earthen material bank—a sloped pile of earthen rubble comprising a surface that has been prepared for material removal.

electric mining shovel—an electrically-powered device adapted to dig, hold, and/or move earthen materials.

energize—to provide electricity to.

establish—to create, form, and/or set-up.

estimate—(n.) a calculated value approximating an actual value; (v.) to calculate and/or determine approximately and/or tentatively.

excavate—to move material, including any subterranean, submarine, and/or surface material.

exceed—to be greater than.

extractable—capable of being removed from a location via a single mine hauling vehicle.

from—used to indicate a source.

generate—to create, produce, render, give rise to, and/or bring into existence.

Global Position System (GPS)—a system adaptable to determine a terrestrial location of a device receiving signals from multiple satellites.

haptic—involving the human sense of kinesthetic movement and/or the human sense of touch. Among the many potential haptic experiences are numerous sensations, body-positional differences in sensations, and time-based changes in sensations that are perceived at least partially in non-visual, non-audible, and non-olfactory manners, including the experiences of tactile touch (being touched), active touch, grasping, pressure, friction, traction, slip, stretch, force, torque, impact, puncture, vibration, motion, acceleration, jerk, pulse, orientation, limb position, gravity, texture, gap, recess, viscosity, pain, itch, moisture, temperature, thermal conductivity, and thermal capacity.

higher—greater than.

hoist—(n) a system adapted to at least vertically move a bucket of an excavating machine, such as a mining shovel and/or dragline-mining machine. A hoist can comprise a motor, gearbox, clutch, hydraulic system, one or more pulleys, one or more cables, and/or one or more sensors; (v) to lift and/or raise.

hoist motor—the moment of a force related to moving a bucket of a mining shovel, the movement having a predominantly vertical component.

hoist torque—a torque of a motor that provides a motive force to a system adapted to at least vertically move a bucket of a mining excavator.

information—facts, terms, concepts, phrases, expressions, commands, numbers, characters, and/or symbols, etc., that are related to a subject. Sometimes used synonymously with data, and sometimes used to describe organized, transformed, and/or processed data. It is generally possible to automate certain activities involving the management, organization, storage, transformation, communication, and/or presentation of information.

information device—any device on which resides a finite state machine capable of implementing at least a portion of a method, structure, and/or or graphical user interface described herein. An information device can comprise well-known communicatively coupled components, such as one or more network interfaces, one or more processors, one or more memories containing instructions, one or more input/output (I/O) devices, and/or one or more user interfaces (e.g., coupled to an I/O device) via which information can be rendered to implement one or more functions described herein. For example, an information device can be any general purpose and/or special purpose computer, such as a personal computer, video game system (e.g., PlayStation, Nintendo Gameboy, X-Box, etc.), workstation, server, minicomputer, mainframe, supercomputer, computer terminal, laptop, wearable computer, and/or Personal Digital Assistant (PDA), iPod, mobile terminal, Bluetooth device, communicator, "smart" phone (such as a Treo-like device), messaging service (e.g., Blackberry) receiver, pager, facsimile, cellular telephone, a traditional telephone, telephonic device, a programmed microprocessor or microcontroller and/or peripheral integrated circuit elements, a digital signal processor, an ASIC or other integrated circuit, a hardware electronic logic circuit such as a discrete element circuit, and/or a programmable logic device such as a PLD, PLA, FPGA, or PAL, or the like, etc.

laser (acronym for light amplification by stimulated emission of radiation)—a device that produces a narrow beam of electromagnetic energy by recirculating an internal beam many times through an amplifying medium, each time adding a small amount of energy to the recirculating beam in a phase-coherent manner.

load—(n.) a substantial force and/or an amount of mined earthen material associated with a dipper and/or truck, etc.; (v.) to place material into a container and/or vehicle.

load cycle—a time interval beginning when a mine shovel digs earthen material and ending when a bucket of the mining shovel is emptied into a haulage machine.

location—a place.

machine-implementable instructions—directions adapted to cause a machine, such as an information device, to perform one or more particular activities, operations, and/or functions. The directions, which can sometimes form an entity called a "processor", "operating system", "program", "application", "utility", "subroutine", "script", "macro", "file", "project", "module", "library", "class", and/or "object", etc., can be embodied as machine code, source code, object code, compiled code, assembled code, interpretable code, and/or executable code, etc., in hardware, firmware, and/or software.

machine readable medium—a physical structure from which a machine, such as an information device, computer, microprocessor, and/or controller, etc., can obtain and/or store data, information, and/or instructions. Examples include memories, punch cards, and/or optically-readable forms, etc.

manage—to exert control over.

material—any substance that can be excavated and/or scooped.

material weight processor—a processor adapted to calculate and/or determine a heaviness of a substance.

may—is allowed and/or permitted to, in at least some embodiments.

measure—to characterize by physically sensing.

measurement—a value of a variable, the value determined by manual and/or automatic observation.

memory device—an apparatus capable of storing analog or digital information, such as instructions and/or data. Examples include a non-volatile memory, volatile memory, Random Access Memory, RAM, Read Only Memory, ROM, flash memory, magnetic media, a hard disk, a floppy disk, a magnetic tape, an optical media, an optical disk, a compact disk, a CD, a digital versatile disk, a DVD, and/or a raid array, etc. The memory device can be coupled to a processor and/or can store instructions adapted to be executed by processor, such as according to an embodiment disclosed herein.

method—a process, procedure, and/or collection of related activities for accomplishing something.

mine—an excavation in the earth from which materials can be extracted.

mining excavator—a machine adapted to move materials relative to an earthen surface. Excavating machines comprise excavators, backhoes, front-end loaders, mining shovels, and/or electric mining shovels, etc.

mining haulage vehicle—a motorized machine adapted to haul material extracted from the earth.

mining haulage vehicle load processor—a processor adapted to detect and/or determine an amount and/or location of material to be loaded on a mining haulage vehicle.

mining haulage vehicle position processor—a processor adapted to detect and/or determine a present and/or desired location of a mining haulage vehicle.

motor—an electric, hydraulic, and/or pneumatic device that produces or imparts linear and/or angular motion.

network—a communicatively coupled plurality of nodes, communication devices, and/or information devices. Via a network, such devices can be linked, such as via various wireline and/or wireless media, such as cables, telephone lines, power lines, optical fibers, radio waves, and/or light beams, etc., to share resources (such as printers and/or memory devices), exchange files, and/or allow electronic communications therebetween. A network can be and/or can utilize any of a wide variety of sub-networks and/or protocols, such as a circuit switched, public-switched, packet switched, connection-less, wireless, virtual, radio, data, telephone, twisted pair, POTS, non-POTS, DSL, cellular, telecommunications, video distribution, cable, terrestrial, microwave, broadcast, satellite, broadband, corporate, global, national, regional, wide area, backbone, packet-switched TCP/IP, IEEE 802.03, Ethernet, Fast Ethernet, Token Ring, local area, wide area, IP, public Internet, intranet, private, ATM, Ultra Wide Band (UWB), Wi-Fi, BlueTooth, Airport, IEEE 802.11, IEEE 802.11a, IEEE 802.11b, IEEE 802.11g, X-10, electrical power, multi-domain, and/or multi-zone sub-network and/or protocol, one or more Internet service providers, and/or one or more information devices, such as a switch, router, and/or gateway not directly connected to a local area network, etc., and/or any equivalents thereof.

network interface—any physical and/or logical device, system, and/or process capable of coupling an information device to a network. Exemplary network interfaces comprise a telephone, cellular phone, cellular modem, telephone data modem, fax modem, wireless transceiver, Ethernet card, cable modem, digital subscriber line interface, bridge, hub, router, or other similar device, software to manage such a device, and/or software to provide a function of such a device.

obtain—to receive, get, take possession of, procure, acquire, calculate, determine, and/or compute.

operator—an entity able to control a machine.

output—(n) something produced and/or generated; data produced by an information device executing machine-readable instructions; and/or the energy, power, work, signal, and/or information produced by a system. (v) to provide, produce, manufacture, and/or generate.

perform—to begin, take action, do, fulfill, accomplish, carry out, and/or complete, such as in accordance with one or more criterion.

plurality—the state of being plural and/or more than one.

portion—a part, component, section, percentage, ratio, and/or quantity that is less than a larger whole. Can be visually, physically, and/or virtually distinguishable and/or non-distinguishable.

position—(n) a place and/or location, often relative to a reference point. (v) to place and/or locate.

predetermine—to determine, decide, or establish in advance.

predetermined threshold—a limit established in advance.

preferred—improved as compared to an alternative.

process—(n.) an organized series of actions, changes, and/or functions adapted to bring about a result; (v.) to perform mathematical and/or logical operations according to programmed instructions in order to obtain desired information and/or to perform actions, changes, and/or functions adapted to bring about a result.

processor—a hardware, firmware, and/or software machine and/or virtual machine comprising a set of machine-readable instructions adaptable to perform a specific task. A processor can utilize mechanical, pneumatic, hydraulic, electrical, magnetic, optical, informational, chemical, and/or biological principles, mechanisms, signals, and/or inputs to perform the task(s). In certain embodiments, a processor can act upon information by manipulating, analyzing, modifying, and/or converting it, transmitting the information for use by an executable procedure and/or an information device, and/or routing the information to an output device. A processor can function as a central processing unit, local controller, remote controller, parallel controller, and/or distributed controller, etc. Unless stated otherwise, the processor can be a general-purpose device, such as a microcontroller and/or a microprocessor, such the Pentium IV series of microprocessor manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein. A processor can reside on and use the capabilities of a controller.

profile—a representation, outline, and/or description of an object, structure, and/or surface.

project—to calculate, estimate, or predict.

prompt—to advise and/or remind.

provide—to furnish, supply, give, convey, send, and/or make available.

proximity sensor—a device adapted to detect a distance from an object.

radar—a device and/or system adapted to detect and/or determine a position, velocity, and/or other characteristics of an object by analysis of radio waves reflected from a surface of the object.

read—to obtain from a memory device.

receive—to gather, take, acquire, obtain, accept, get, and/or have bestowed upon.

regarding—pertaining to.

relative—considered with reference to and/or in comparison to something else.

relocate—transfer from one location to another.

render—to display, annunciate, speak, print, and/or otherwise make perceptible to a human, for example as data, commands, text, graphics, audio, video, animation, and/or hyperlinks, etc., such as via any visual, audio, and/or haptic mechanism, such as via a display, monitor, printer, electric paper, ocular implant, cochlear implant, speaker, etc.

request—(v.) to express a need and/or desire for; to inquire and/or ask for. (n.) that which communicates an expression of desire and/or that which is asked for.

responsive—reacting to an influence and/or impetus.

result—an outcome and/or consequence of a particular action, operation, and/or course.

said—when used in a system or device claim, an article indicating a subsequent claim term that has been previously introduced.

scan—(n.) information obtained via a systematic examination; (v.) to systematically examine.

select—to make and/or indicate a choice and/or selection from among alternatives.

sensor—a device adapted to automatically sense, perceive, detect, and/or measure a physical property (e.g., pressure, temperature, flow, mass, heat, light, sound, humidity, proximity, position, velocity, vibration, loudness, voltage, current, capacitance, resistance, inductance, and/or electro-magnetic radiation, etc.) and convert that physical quantity into a signal. Examples include proximity switches, stain gages, photo sensors, thermocouples, level indicating devices, speed sensors, accelerometers, electrical voltage indicators, electrical current indicators, on/off indicators, and/or flowmeters, etc.

set—a related plurality of predetermined elements; and/or one or more distinct items and/or entities having a specific common property or properties.

signal—information, such as machine instructions for activities and/or one or more letters, words, characters, symbols, signal flags, visual displays, and/or special sounds, etc. having prearranged meaning, encoded as automatically detectable variations in a physical variable, such as a pneumatic, hydraulic, acoustic, fluidic, mechanical, electrical, magnetic, optical, chemical, and/or biological variable, such as power, energy, pressure, flowrate, viscosity, density, torque, impact, force, frequency, phase, voltage, current, resistance, magnetomotive force, magnetic field intensity, magnetic field flux, magnetic flux density, reluctance, permeability, index of refraction, optical wavelength, polarization, reflectance, transmittance, phase shift, concentration, and/or temperature, etc. Depending on the context, a signal and/or the information encoded therein can be synchronous, asynchronous, hard real-time, soft real-time, non-real time, continuously generated, continuously varying, analog, discretely generated, discretely varying, quantized, digital, broadcast, multicast, unicast, transmitted, conveyed, received, continuously measured, discretely measured, processed, encoded, encrypted, multiplexed, modulated, spread, de-spread, demodulated, detected, de-multiplexed, decrypted, and/or decoded, etc.

simulate—to create as a representation or model of another thing.

simulator—an apparatus and/or system that generates inputs approximating actual or operational conditions.

specify—to describe, characterize, indicate, and/or state explicitly and/or in detail.

speed—a linear, curvilinear, and/or angular velocity and/or a linear, curvilinear, and/or angular distance traveled during a predetermined time interval.

stall condition—a circumstance of becoming substantially stationary and/or without motion.

store—to place, hold, retain, enter, and/or copy into and/or onto a machine-readable medium.

substantially—to a considerable, large, and/or great, but not necessarily whole and/or entire, extent and/or degree.

swing—to move laterally and/or in a curve. With respect to a mining excavator the turning of the excavator around its center axis.

system—a collection of mechanisms, devices, machines, articles of manufacture, processes, data, and/or instructions, the collection designed to perform one or more specific functions.

through—in one side and out the opposite or another side of, across, among, and/or between.

torque—a moment of a force acting upon an object; a measure of the force's tendency to produce torsion and rotation in the object about an axis equal to the vector product of the radius vector from the axis of rotation to the point of application of the force and the force vector. Equivalent to the product of angular acceleration and mass moment of inertia of the object.

total torque—a sum of all partial torques associated with movement of a device and/or system with regard to a predetermined axis.

transfer—(n) a transmission from one device, place, and/or state to another. (v) to convey from one device, place, and/or state to another.

transmit—to provide, furnish, supply, send as a signal, and/or to convey (e.g., force, energy, and/or information) from one place and/or thing to another.

use—to employ.

user interface—a device and/or software program for rendering information to a user and/or requesting information from the user. A user interface can include at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projector, and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, autosizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

value—a measured, assigned, determined, and/or calculated quantity or quality for a variable and/or parameter.

via—by way of and/or utilizing.

volume—a quantity of space that a substance occupied.

weight—a force with which a body is attracted to Earth or another celestial body, equal to the product of the object's mass and the acceleration of gravity; and/or a factor assigned to a number in a computation, such as in determining an average, to make the number's effect on the computation reflect its importance.

wireless—any means to transmit a signal that does not require the use of a wire connecting a transmitter and a receiver, such as radio waves, electromagnetic signals at any frequency, lasers, microwaves, etc., but excluding purely visual signaling, such as semaphore, smoke signals, sign language, etc. Wireless communication can be via any of a plurality of protocols such as, for example, cellular CDMA, TDMA, GSM, GPRS, UMTS, W-CDMA, CDMA2000, TD-CDMA, 802.11a, 802.11b, 802.11g, 802.15.1, 802.15.4, 802.16, and/or Bluetooth, etc.

wireless transmitter—a device adapted to transfer a signal from a source to a destination without the use of wires.

wherein—in regard to which; and; and/or in addition to.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive.

What is claimed is:

1. An excavation system, comprising:

a positionable haulage vehicle for hauling earthen material;

an excavator having a positionable bucket coupled to a hoist motor for excavating earthen material, the excavator having coupled thereto:

a bucket excavation controller adapted to adjust a digging position of a bucket of the mining excavator in an earthen material bank;

a material weight processor adapted to determine a weight of earthen material in the bucket; and a mining haulage vehicle position processor coupled to the excavator, adapted to determine automatically a desired location of a mining haulage vehicle relative to said mining excavator.

2. The system of claim 1, wherein the material weight processor is adapted to determine a weight of earthen material in the bucket while the bucket is digging in an earthen material bank.

3. The system of claim 1, wherein the motor generates torque for hoisting the bucket, and the material weight processor determines the total torque used to hoist the bucket through an earthen material bank, and is adapted to determine a weight of earthen material in the bucket based upon the total torque.

4. The system of claim 1, wherein the material weight processor is adapted to estimate a weight of earthen material in the bucket while the bucket is digging in the earthen material bank based upon a detected volume of earthen material in the bucket.

5. The system of claim 1, wherein the mining haulage vehicle position processor is adapted to automatically prompt an operator of the mining haulage vehicle regarding the desired location of the mining haulage vehicle relative to the mining excavator.

6. The system of claim 1, further comprising:

a mining haulage vehicle load processor adapted to, based upon a received scan of a bed of a mining haulage vehicle, automatically determine a desired location of said bucket relative to said bed of said mining haulage vehicle.

7. The system of claim 6, wherein the mining haulage vehicle load processor automatically swings the bucket to load the mining haulage vehicle.

8. The system of claim 1, wherein:

the bucket excavation controller is responsive to an automatically detected stall condition at the hoist motor, and in response thereto automatically controls a crowd motion of the bucket, and wherein the stall condition is detected based upon a deviation between a desired speed of the hoist motor and the speed of the hoist motor.

9. The system of claim 1, wherein: the bucket excavation controller is responsive to an automatically detected stall condition at the hoist motor, and in response thereto automatically controls a crowd motion of the bucket, and wherein the stall condition is detected based upon a determination that speed of the hoist motor that is below a predetermined threshold and a hoist torque generated by the hoist motor is above a predetermined threshold.

10. An excavation system, comprising:

a positionable haulage vehicle for hauling earthen material;

an excavator having a positionable bucket coupled to a hoist motor for excavating earthen material;

a bucket excavation controller, coupled to the excavator, adapted to:

responsive to an automatically detected stall) condition at the hoist motor, automatically) control a crowd motor of the mining excavator, the crowd motor adapted to adjust a position of the bucket in an earthen material bank; and responsive to an automatic determination that a speed of the hoist motor exceeds a predetermined threshold, automatically control the crowd motor to adjust the bucket position in the earthen material bank;

a material weight processor, coupled to the bucket excavation controller, adapted to determine a weight of earthen material in the bucket;

a mining haulage vehicle position processor coupled to the excavator, adapted to determine automatically a desired location of a mining haulage vehicle relative to the mining excavator; and a mining haulage vehicle load processor adapted to, based upon a received scan of a bed of the mining haulage vehicle, determine automatically a desired location of the bucket relative to the bed of the mining haulage vehicle.

11. The system of claim 10, wherein the material weight processor is adapted to determine weight of earthen material in the bucket while the bucket is digging in the earthen material bank.

12. The system of claim 10 wherein the motor generates torque for hoisting the bucket, and the material weight processor determines the total torque used to hoist the bucket through the earthen material bank, and is adapted to determine weight of earthen material in the bucket based upon the total torque.

13. The system of claim 10, wherein the material weight processor is adapted to estimate a weight of earthen material in the bucket while the bucket is digging in the earthen material bank based upon a detected volume of earthen material in the bucket.

14. The system of claim 10, wherein the mining haulage vehicle position processor is adapted to automatically prompt an operator of the mining haulage vehicle regarding the desired location of the mining haulage vehicle relative to the mining excavator.

15. The system of claim 10, wherein at least one of the processors is implemented in a programmable logic controller coupled to at least one drive controller operating the hoist motor.

16. The system of claim 10, wherein at least one of the processors is implemented in a programmable logic controller coupled to at least one drive controller operating the crowd motor.

17. The system of claim 16, wherein the programmable logic controller includes an adaptive predictive controller for positioning the bucket.

18. An excavation system, comprising:

a positionable haulage vehicle for hauling earthen material;

an excavator having a positionable bucket coupled to a hoist motor for excavating earthen material;

a bucket excavation controller, coupled to the excavator, adapted to:

responsive to an automatically detected stall condition at the hoist motor, automatically control a crowd motor of the mining excavator, the crowd motor adapted to adjust a position of the bucket in an earthen material bank; and responsive to an automatic determination that a speed of the hoist motor exceeds a predetermined threshold, automatically control the crowd motor to adjust the bucket position in the earthen material bank;

a material weight processor, coupled to the bucket excavation controller, adapted to determine a weight of earthen material in the bucket and thereby enabling the bucket excavation controller to adjust bucket position on the basis of the determined weight;

a mining haulage vehicle position processor coupled to the excavator and the haulage vehicle, adapted to determine automatically a desired location of a mining haulage vehicle relative to the mining excavator and thereby enabling the excavator and hauler to adjust their relative positions to the desired location; and a mining haulage vehicle load processor, coupled to the bucket excavation controller, the haulage vehicle load processor adapted to, based upon a received scan of a bed of the mining haulage vehicle, determine automatically a desired location of the bucket relative to the bed of the mining haulage vehicle, and thereby causing the bucket excavation controller to adjust bucket position to the desired location.

* * * * *